United States Patent [19]

Lovecchio et al.

[11] Patent Number: 4,568,633

[45] Date of Patent: Feb. 4, 1986

[54] PHOTOGRAPHIC ELEMENTS AND PROCESSES UTILIZING IMAGEWISE REDUCTION OF FERRIC IONS

[75] Inventors: Frank V. Lovecchio; James A. Reczek; Robert C. Stewart, all of Rochester, N.Y.

[73] Assignee: Eastman Kodak Company, Rochester, N.Y.

[21] Appl. No.: 688,477

[22] Filed: Jan. 2, 1985

[51] Int. Cl.[4] ..... G03C 1/40; G03C 7/26

[52] U.S. Cl. ..... 430/367; 430/371; 430/375; 430/542

[58] Field of Search ..... 430/359, 367, 371, 375, 430/542

[56] References Cited

U.S. PATENT DOCUMENTS

| | | | |
|---|---|---|---|
| 1,305,962 | 6/1919 | Crabtree . | |
| 1,389,742 | 9/1921 | Crabtree | 430/367 |
| 1,776,155 | 9/1930 | Kögel | 430/540 |
| 1,945,772 | 2/1934 | Dassonville | 430/367 |
| 2,264,334 | 12/1941 | Schmidt | 430/368 |
| 2,533,182 | 12/1950 | Sargent | 430/375 |
| 3,660,092 | 5/1972 | Frank et al. | 430/359 |

FOREIGN PATENT DOCUMENTS

| | | | |
|---|---|---|---|
| 59-44773 | 3/1984 | Japan . | |
| 670883 | 4/1952 | United Kingdom . | |
| 701843 | 1/1954 | United Kingdom | 430/543 |

OTHER PUBLICATIONS

Tanaka et al., *Photo. Sci. Eng.,* 25(1), pp. 32–34 (1981).

Schilt, *Talanta,* 13, pp. 895–902 (1966).

*Primary Examiner*—Richard L. Schilling

*Attorney, Agent, or Firm*—J. Lanny Tucker

[57] ABSTRACT

A process for obtaining highly stable color photographic images utilizes a silver halide photographic element comprising an essentially colorless, immobile compound which is capable of complexing with ferrous ions to form a dye. The complexing compound contains a complexing moiety which is represented by the formula:

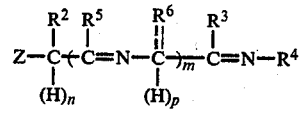

wherein m is zero or a positive integer 1 to 3, n and p are independently 0 or 1 and ⚌ represents a single or double bond. Z is $R^1$—N⚌, O⚌, S⚌, $R^1$—P⚌, $(R^1)_2P$— or $(R^1)_3P$⚌, and when Z is $(R^1)_2P$—, n is 1, otherwise n is 0. $R^1$, $R^2$, $R^3$, $R^4$, $R^5$ and $R^6$ are independently hydrogen, amino, hydroxy, mercapto, alkoxy, alkyl, aryl or a heterocyclic moiety. When $R^6$ is so defined, p is 1 and ⚌ is a single bond. If m is 0, $R^1$ and $R^2$, $R^2$ and $R^3$, and $R^3$ and $R^4$ taken together can independently represent the carbon and heteroatoms necessary to complete a substituted or unsubstituted carbocyclic or heterocyclic nucleus, or if m is 1 to 3, $R^1$ and $R^2$, $R^5$ and $R^6$, and $R^3$ and $R^4$ can independently represent the carbon and heteroatoms necessary to complete a substituted or unsubstituted heterocyclic nucleus. When $R^5$ and $R^6$ are so defined, p is 0 when ⚌ is a double bond, and p is 1 when ⚌ is a single bond.

12 Claims, No Drawings

PHOTOGRAPHIC ELEMENTS AND PROCESSES UTILIZING IMAGEWISE REDUCTION OF FERRIC IONS

RELATED APPLICATIONS

Reference is made to the following copending and commonly assigned applications, all filed on even date herewith: U.S. Ser. No. 688,478 by J. A. Reczek and J. M. Palumbo, U.S. Ser. No. 688,479 by W. N. Washburn, and U.S. Ser. No. 688,224 by W. N. Washburn and K. R. Hollister.

FIELD OF THE INVENTION

The invention relates to color photography. In particular, it relates to an imaging process for providing stable color images in photographic elements utilizing the reduction of ferric ions to ferrous ions. It also relates to photographic elements which can be used in this process.

BACKGROUND OF THE INVENTION

It is well known in the photographic arts to record color images with photographic elements containing dye-providing materials which can be used to provide color images. Although the properties of dyes commonly used to provide such images (e.g. azo or azomethine dyes) have been optimized over the years, there is a continued search in the art for dyes which provide images having improved stability to heat, humidity and chemical reagents.

Image formation based on metal chelate formation has generally been favorably regarded. The properties of the metal-ligand complexes can be manipulated by changes in both the metal and the complexing ligand. Also, metal complex dyes as a class are considered to have exceptional stability. Complexes of ferrous ions and various chromophore ligands are known to be quite stable, some having formation constants (pK) of from about 13 to about 24. Some of these complexes have been traditionally used in analytical chemistry procedures where mere color formation is important rather than a particular color hue or speed of color formation.

Iron complexes have also been used in imaging processes, for example to prepare "blue prints." In U.S. Pat. No. 1,776,155 (issued Sept. 16, 1930 to Kogel), photographic images are obtained using light-sensitive ferric salts which are reduced upon exposure to light. The resulting ferrous ions complex with certain ketones to provide a bluish color image. These elements, however, suffer from poor speed, meaning that they are not light sensitive enough for modern photographic uses. Similar light sensitive materials are described in U.S. Pat. No. 2,264,334 (issued Dec. 2, 1941 to Schmidt).

U.S. Pat. No. 3,660,092 (issued May 2, 1972 to Frank et al) relates to formation of color images in photographic elements using heavy metal salt-dye complexes. Heavy metal salts useful in the described elements include iron salts among many others. In the embodiment using iron salts, a silver halide image is first converted to a mercury salt image which is then converted to an iron salt image which releases iron to react with a ligand to form a color dye image. This imaging process, however, has several disadvantages. The use of iron complexes also requires the use of mercury in the reaction sequence. Mercury is a potential contaminent in photographic systems and should be avoided if possible. Further, the imaging process described in this reference is based on the conversion of silver halide to a metal complex, and involves a complex series of processing steps to obtain a negative image.

It would, therefore, be desirable to form highly stable color images formed with dye precursors which are essentially colorless prior to imagewise exposure. It is also desired that the process providing such images would be simple and exhibit high sensitivity (i.e. good speed) to exposing actinic radiation.

SUMMARY OF THE INVENTION

The present invention provides a means for obtaining color images of exceptional stability. The dyes formed in the practice of this invention show desirable stability to a variety of environmental conditions (e.g. heat and humidity) over an extended period. They also generally show improved stability to light.

Further, the process of this invention is simple to use in obtaining photographic images, and exhibits desired versatility in the placement of the dye precursors because they are essentially colorless until exposure to radiation. This invention utilizes complexes of ferrous ions and certain essentially colorless and immobile compounds. The elements used in the practice of this invention exhibit good speed (i.e. high sensitivity to exposing radiation) and their use avoids the complicated imaging process taught in the Frank et al patent noted hereinabove.

The advantages of the present invention are obtainable because the essentially colorless complexing compounds remain colorless until they come in contact with ferrous ions. These ions are provided by reduction of ferric ions which can be in the element or brought into contact with the element after imagewise exposure and development. For example, imagewise distributed silver metal reduces the ferric ions, thereby providing ferrous ions available for imagewise complexing with the colorless compounds to form a dye.

Therefore, in accordance with this invention, there is provided a process of forming a dye image in an element comprising a support having thereon at least one silver halide emulsion layer which has associated therewith an essentially colorless, immobile compound which is capable of complexing with ferrous ions. This complexing compound contains a complexing moiety which is represented by the structure:

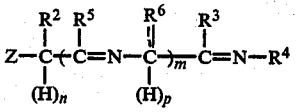

wherein m is zero or a positive integer 1 to 3, n and p are independently 0 or 1 and $\cdots$ represents a single or double bond. Z is $R^1$—N═, O═, S═, $R^1$—P═, $(R^1)_2P$— or $(R^1)_3P$═, and when Z is $(R^1)_2P$—, n is 1, otherwise n is 0. $R^1$, $R^2$, $R^3$, $R^4$, $R^5$ and $R^6$ are independently hydrogen, amino, hydroxy, mercapto, alkoxy, alkyl, aryl or a heterocyclic moiety. When $R^6$ is so defined, p is 1 and $\cdots$ is a single bond. If m is 0, $R^1$ and $R^2$, $R^2$ and $R^3$, and $R^3$ and $R^4$ taken together can independently represent the carbon and heteroatoms necessary to complete a substituted or unsubstituted carbocyclic or heterocyclic nucleus, or if m is 1 to 3, $R^1$ and $R^2$, $R^5$ and $R^6$, and $R^3$ and $R^4$ can independently represent the carbon and heteroatoms necessary to complete a substituted or unsubstituted heterocyclic nucleus. When $R^5$ and $R^6$ are so defined, p is 0 when is a double bond, and p is 1 when is a single bond.

The process of this invention comprises the steps of forming an imagewise distribution of a reducing agent for ferric ions, reducing a ferric compound with the reducing agent to provide an imagewise distribution of ferrous ions, and causing the ferrous ions to react with the complexing compound to form a ferrous ion complex dye.

This invention also provides an element comprising a support having thereon at least one silver halide emulsion layer which has associated therewith an essentially colorless, immobile complexing compound as described hereinabove.

DETAILED DESCRIPTION OF THE INVENTION

The advantages described hereinabove for this invention are attained because of the use of a particular class of essentially colorless, immobile complexing compounds. These compounds can complex with ferrous ions to form useful stable dyes, such as cyan, magenta and yellow dyes useful in photographic products.

The complexing compounds useful in the practice of this invention are "essentially colorless," meaning that prior to complexation of the compound with ferrous ions to form a visible dye, the compound exhibits essentially no observable color. That is, it generally exhibits a low optical density (i.e. less than about 0.05), although it may emit or reflect electromagnetic radiation in the non-visible portions of the electromagnetic spectrum. Therefore, the complexing compounds and the ferrous ions "form" a colored dye from a colorless precursor, as opposed to compounds which are merely shifted in their absorption $\lambda_{max}$ upon complexation with a ferrous ion to provide a dye of a different color.

Generally the dyes formed upon complexation of the compounds and ferrous ions are visibly colored dyes. That is, they absorb electromagnetic radiation in the visible portion of the electromagnetic spectrum, i.e. between about 400 and about 700 nm. More than one molecule of a complexing compound can be complexed with one ferrous ion. For example, there may be two or three complexing compound molecules complexed with a single ferrous ion.

Useful nonpolymeric complexing compounds are ferroin type compounds such as hydrazones, tetrazolylpyridines, pyridylquinazolines, bis-isoquinolines, imines, phenanthrolines, bipyridines, terpyridines, bidiazines, pyridyldiazines, pyridylbenzimidazoles, diazyltriazines, o-nitrosoanilines and phenols, tetrazines, triazines described by Schilt et al in the journal *Talanta,* 15, pp. 475–478 (1968), pyridine derivatives of phenazine and quinoxaline described by Schilt et al in *Talanta,* 15, pp. 852–855 (1968), substituted benzimidazole derivatives as described by Schilt et al, *Talanta,* 15, pp. 1055–1058 (1968), oximes of substituted methyl and phenyl 2-pyridyl ketones as described by Schilt et al, *Talanta,* 16, pp. 448–452 (1969), and the like. Other complexing compounds are described in the following *Talanta* literature articles: 16, pp. 519–522 (1969), 13, pp. 895–902 (1966), 17, pp. 649–653 (1970), 19, pp. 1025–1031 (1972), 21, pp. 831–836 (1974), 22, pp. 915–917 (1975), 23, pp. 543–545 (1976), 24, pp. 685–687 (1977), 26, pp. 85–89 (1979), pp. 863–865 (1981), 36, pp. 373–376 (1979), 55, pp. 55–58 (1980), 29, pp 129–132 (1982), and in Blandamer et al, *J. Chem. Soc. Dalton,* pp. 1001–1008 (1978), Case, *J. Org. Chem.,* 31, pp. 2398–2400 (1966) and U.K. Pat. No. 701,843 (published Jan. 6, 1954). The terpyridines are particularly useful for obtaining magenta dyes.

The nonpolymeric complexing compound can have a ballast group which renders it nondiffusible in the photographic element during processing. The ballast group is generally an organic group of such molecular size and configuration as to render the compound nondiffusible in a photographic element during development in an alkaline processing composition. Particularly useful ballast groups include long chain alkyl groups (e.g. 6 to 30 carbon atoms), as well as aromatic groups (phenyl, naphthyl) along with alkyl groups. Representative ballast groups include $-CO-C_{11}H_{23}$, $-CO-C_6H_4(t\text{-}C_{12}H_{25})$, $-CON(C_{12}H_{25})_2$, $-NHSO_2C_{16}H_{33}$, $-C_7H_{15}$, 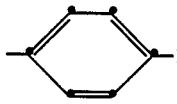 $-NHSO_2C_{16}H_{33}$, $-SO_2NHC_{18}H_{37}$, $-OC_{12}H_{25}$,

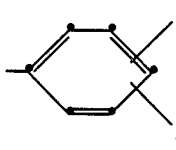

, and $-N$ ($C_{18}H_{37}$, $CH_2CH_2SO_3^-Na^+$).

Alternatively, the complexing compound can be a polymer chain which has one or more complexing moieties attached to the polymer backbone in a suitable manner. These polymers are bulky enough to be immobile in a coated layer, i.e. they are self-ballasting.

Polymers to which complexing moieties can be attached are those having reactive groups that readily react with complementary reactive groups on a nonpolymeric complexing compound or are polymerized from monomers containing such moieties. For example, groups which easily undergo condensation reactions are quite useful. Acid derivatives including free carboxylic acids, acid chlorides and anhydrides readily condense with hydroxy, amine, and mercapto groups to split out small molecules and form the desired monomer or polymer condensation product. The same can be accomplished with addition reactions, e.g. a hydroxy or amine group adds readily to an isocyanate group to form urethane or ureylene linkages, or an activated unsaturated group (acryloyl) adds readily to an amine group, or by any other reactions known in the art. The monomers can then be polymerized to form the polymers using conventional polymerization techniques. Thus, any polymers or monomers, preferably vinyl polymers or monomers, containing requisite reactive groups complementary to reaction groups on the nonpolymeric complexing compound to be attached to the polymer are useful in forming polymeric complexing compounds or monomers useful in making same. Polymers and monomers containing carboxylic acid, carboxylic acid halides, carboxylic acid anhydride, sulfonic acid, hydroxy, epoxy, amino, isocyanate, etc. groups are especially useful. More specifically, copolymers of acrylic acid, methacrylic acid, maleic anhydride, 2-hydroxyethyl acrylate, glycidyl methacrylate, and the like, have useful reactive groups. The preparation and properties of such polymers are given in various polymer textbooks such as M. P. Stevens *Polymer Chemistry An Introduction,* Addison-Wesley Publishing Co., Inc., Reading, Mass. (1975) and W. R. Sorenson and T. W. Campbell, *Preparative Methods of Polymer Chemistry,* 2nd Ed., Wiley, New York, N.Y. (1968). Comonomers useful in preparing the complexing compounds can be any that are compatible with the preparative reactions involved and whose substituents do not interfere with the photographic process. Acrylamide, acrylamide derivatives and other hydrophilic comonomers are particularly useful.

Example 8 below illustrates a specific polymeric complexing compound which contains a moiety which complexes with ferrous ions to form a magenta dye.

Particularly useful complexing compounds (polymeric or nonpolymeric) have complexing moieties which are represented by the structure:

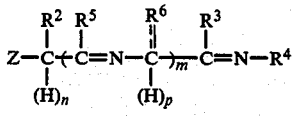

wherein m is 0 or a positive integer 1 to 3, n and p are independently 0 or 1, and ═ represents a single or double bond. Z is $R^1$—N═, O═, S═, $R^1$—P═, $(R^1)_2P$— or $(R^1)_3P$═, and when Z is $(R^1)_2P$—, n is 1, otherwise n is 0. Preferably, m is 0 or 1 and Z is $R^1$—N═.

$R^1$, $R^2$, $R^3$, $R^4$, $R^5$ and $R^6$ are independently hydrogen, amino (primary, secondary or tertiary), hydroxy, mercapto, alkoxy (preferably of 1 to 20 carbon atoms, e.g. methoxy, chloromethoxy, ethoxy, octyloxy, alkoxy substituted with imino, etc.), alkyl (preferably of 1 to 20 carbon atoms in the nucleus, e.g. methyl, ethyl, chloromethyl, isopropyl, t-butyl, heptyl, alkyl substituted with imino, etc.), aryl (preferably of 6 to 14 carbon atoms, e.g. phenyl, naphthyl, xylyl, p-methoxyphenyl, aryl substituted with imino, etc.), or a heterocyclic moiety (preferably having 5 to 20 carbon, nitrogen, sulfur or oxygen atoms in the nucleus, e.g. pyridyl, quinolyl, a heterocycle substituted with imino, etc.). In some embodiments, $R^1$ and $R^4$ are not hydroxy.

When $R^6$ is a group defined above, p is 1 and ═ is a single bond.

Alternatively, if m is 0, $R^1$ and $R^2$, $R^2$ and $R^3$, and $R^3$ and $R^4$, taken together, can independently represent the carbon and heteroatoms (e.g. nitrogen, oxygen, sulfur, selenium, etc.) necessary to complete a substituted or unsubstituted 5 to 20 membered mono- or polycyclic carbocyclic or heterocyclic nucleus (e.g. pyridyl, quinolyl, triazinyl, phenanthrolinyl, pyrimidyl, etc.). The heterocyclic nucleus so formed can be substituted with one or more oxo, alkyl, amino, imino, aryl, phosphino (e.g. diphenylphosphino), alkoxy, amide, sulfonamide, thio or sulfo groups as defined above or a heterocyclic group (e.g. pyridyl, pyrimidyl, thiazolyl, imidazolyl, thienyl, etc.).

If m is 1, 2 or 3, $R^1$ and $R^2$, $R^5$ and $R^6$, and $R^3$ and $R^4$, taken together, can represent the carbon and heteroatoms (e.g. nitrogen, oxygen, sulfur, selenium, etc.) necessary to complete a substituted or unsubstituted 5 to 20 membered mono- or polycyclic heterocyclic nucleus as defined above where m is 0. When $R^5$ and $R^6$ are so defined, p is 0 and when ═ is a double bond, and p is 1 when ═ is a single bond.

Examples of useful complexing compounds which form color dyes with ferrous ions are shown below. The $\lambda_{max}$ of each resulting ferrous ion complex dye is also noted.

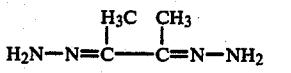

yellow, $\lambda_{max}$ = 442 nm;

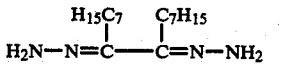

yellow, $\lambda_{max}$ = 443 nm

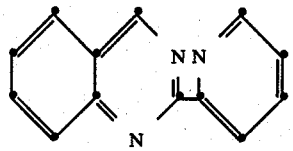

yellow, $\lambda_{max}$ = 441 nm;

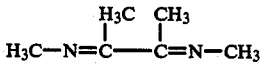

magenta, $\lambda_{max}$ = 564 nm

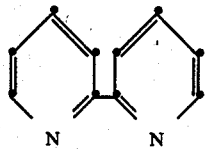

red, $\lambda_{max}$ = 522 nm

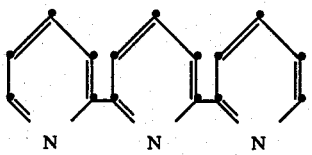

magenta, $\lambda_{max}$ = 552 nm

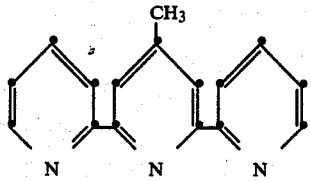

magenta, $\lambda_{max}$ = 557 nm

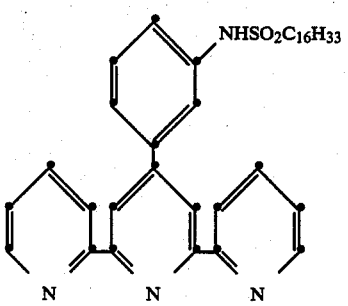

magenta, $\lambda_{max}$ = 571 nm

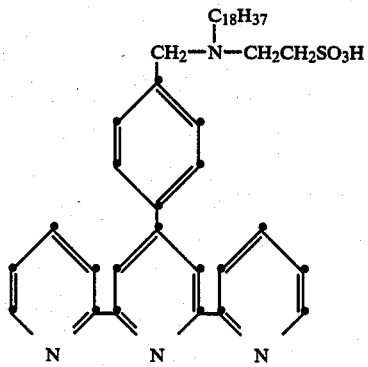

magenta, $\lambda_{max}$ = 567 nm

-continued

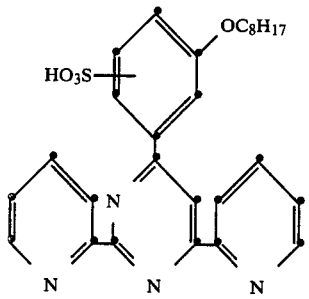

magenta, $\lambda_{max}$ = 583 nm

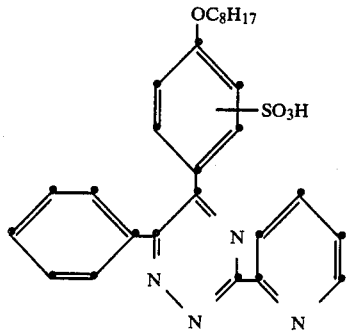

magenta, $\lambda_{max}$ = 557 nm

Polymers represented by the recurring units:

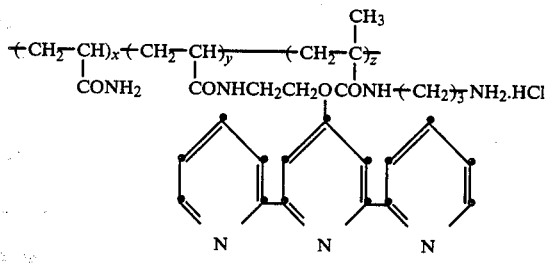

wherein x is 0 to about 90 weight percent, y is from about 2 to about 60 weight percent, and z is 0 to about 40 weight percent.

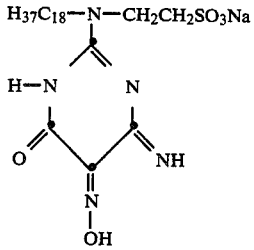

cyan, $\lambda_{max}$ = 644 nm

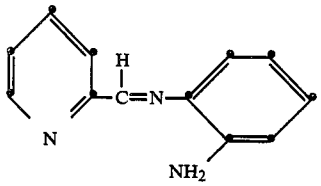

cyan, $\lambda_{max}$ = 670 nm and

-continued

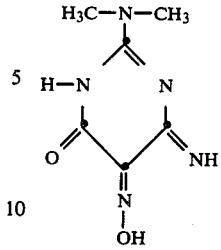

cyan, $\lambda_{max}$ = 650 nm.

magenta, $\lambda_{max}$ = 561 nm wherein x is 65, y is 30 and z is 5

The complexing compounds useful in the practice of this invention can be readily prepared using techniques known in the art. See, for example the *Talanta* references noted above as well as U.K. Pat. No. 701,843 relating to nonpolymeric compounds. Polymeric compounds are easily prepared as described above using conventional synthetic methods. Representative syntheses of useful complexing compounds are described in Examples 1, 5 and 7 below.

As noted above, the described complexing compound is capable of complexing with ferrous ions to form a highly stable dye in one or more layers of a photographic element. In general, the log of the formation constant of such complexes is in the range of from about 10 to about 30, and preferably from about 15 to about 25.

The process of this invention can be used to generate a variety of types of colored images. For example, the process can be used to generate color images in conventional photographic elements which utilize silver halide e.g. color papers, color films, diffusion transfer elements, and the like, the detailed description of which are within the skill of an ordinary worker in the photographic art (see, e.g. *Research Disclosure* publications 15162 and 17643 noted below.

The process of this invention is carried out by physically contacting the ferric compound with an imagewise distribution of silver. For example, the process can be accomplished with an element comprising a support having thereon at least one silver halide emulsion layer which has associated therewith a complexing compound as described above. The process comprises the steps of:

imagewise exposing and developing the silver halide emulsion layer to provide an imagewise distribution of metallic silver, physically contacting the metallic silver with a ferric compound, thereby reducing the ferric compound and providing an imagewise pattern of ferrous ions, and causing the ferrous ions to react with the complexing compound to form a ferrous ion complex dye.

In this process, the ferric compound can be provided in a processing or other solution. Alternatively, the ferric compound can be provided in a cover sheet which is applied to the element containing the complexing compound after or during imagewise development. The complexing compound is in the silver halide emulsion layer or in a layer associated therewith.

The photographic elements of this invention can be processed by conventional techniques in which the processing solutions or compositions are incorporated in the element or are separately applied in a solution or process sheet. These solutions or compositions contain developing agents (e.g. color developing agents) and other conventional processing addenda. More specifically, processing of the elements of this invention can be accomplished by conventional silver development, either color or black and white, for example, by treatment with a hydroquinone developer, followed by bleaching with an $Fe^{+3}$ salt bleach.

Photographic elements of this invention generally comprise a support and one or more silver halide emulsion layers and associated dye-forming layers. The complexing compounds can be incorporated in one or more of the silver halide emulsion layers or in other layers, such as adjacent layers, associated with the emulsion layers. The silver halide emulsion layer can contain, or have associated with it, photographic coupler compounds, such as color forming couplers, colored masking couplers, etc. These coupler compounds can form dyes of the same or different color or hue as the dyes formed by complexation of complexing compound and ferrous ions. Additionally, the silver halide emulsion layer can contain other addenda conventionally contained in such layers.

In one embodiment, a multilayer, multicolor photographic element comprises a support having thereon a red-sensitive silver halide emulsion unit having associated therewith a first essentially colorless, immobile complexing compound described above which is capable of complexing with ferrous ions to form a cyan dye, a green-sensitive silver halide emulsion unit having associated therewith a second essentially colorless, immobile complexing compound described above which is capable of complexing with ferrous ions to form a magenta dye and a blue-sensitive silver halide emulsion unit having associated therewith a third essentially colorless, immobile complexing compound described above which is capable of complexing with ferrous ions to form a yellow dye. Each silver halide emulsion unit can be composed of one or more layers and the various units and layers can be arranged in different locations with respect to one another as is known in the art. The complexing compounds described herein can be incorporated into or associated with one or more units or layers of the element. A photographic color paper product is a particularly preferred embodiment of this invention.

Preferably, the second complexing compound in the above multilayer element is a polymer composed of recurring units having the structure:

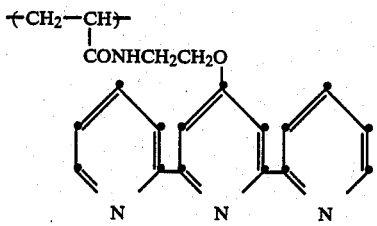

The light sensitive silver halide emulsions can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide and mixtures thereof. The emulsions can be negative-working or direct-positive emulsions. They can form latent images predominantly on the surface of the silver halide grains or predominantly on the interior of the grains. They can be chemically and spectrally sensitized. The emulsions generally are gelatin-containing emulsions although other natural or synthetic hydrophilic colloids or mixtures thereof can be used if desired.

The element support can be any suitable substrate used in photographic elements. Examples of such supports include films of cellulose nitrate, cellulose acetates, poly(vinyl acetal), polyesters [e.g. poly(ethylene terephthalate)], polycarbonates and other resinous materials, glass, metals, paper, and the like. Generally, a flexible paper or resinous film support is used, and a paper support is particularly useful. Paper supports can be acetylated or coated with baryta and/or an $\alpha$-olefin polymer such as polyethylene, polypropylene, ethylene-butene copolymer and the like.

Further details regarding silver halide emulsions and photographic elements, including diffusion transfer elements, are well known in the art as described, for example, in *Research Disclosure,* publication 17643, December, 1978, as well as in *Research Disclosure,* publication 15162, November, 1976 and U.S. Pat. No. 4,358,525 (issued Nov. 9, 1982 to Mooberry et al). *Research Disclosure* is available from Kenneth Mason Publications, Ltd., The Old Harbourmaster's, 8 North St. Emsworth, Hampshire P010 7DD England.

The following examples are provided to illustrate the practice of this invention.

EXAMPLE 1

Cyan Dye Formation in Silver Halide Element

The complexing compound, N-(4-hydroxy-5-nitroso-6-amino-2-pyrimidyl)-N-octadecyl taurine, disodium salt, was prepared according to the teaching in U.K. Pat. No. 701,843 (Example 29) noted above. A coating composition was prepared and coated on a transparent poly(ethylene terephthalate) substrate to form a donor element having 88 mg/m$^2$ of the complexing compound, 1.3 g/m$^2$ of gelatin and 13 mg/m$^2$ of bis(vinylsulfonyl)methyl ether hardener.

A graduated density silver step-image was prepared on a similar substrate. This step-image was obtained by exposing a conventional black-and-white photographic light-sensitive element containing a silver chlorobromide emulsion to a test object in a sensitometer and processing the resulting latent image in a conventional manner with developer, stop and fix solutions to obtain a negative image of metallic silver. The analyzed silver on this step-image ranged from less than 0.1 mg Ag/m$^2$ in the $D_{min}$ (non-exposed) area to 19 mg Ag/m$^2$ in the $D_{max}$ (exposed) area.

A ferric ion solution was prepared having the following composition:

| | |
|---|---|
| ammonium bromide | 150.0 g/l |
| ferric ammonium ethylenediamine-tetraacetate | 99.0 g/l |
| ethylenediaminetetraacetic acid | 40.0 g/l |
| acetic acid (glacial) | 10.5 g/l |
| potassium nitrate (pH adjusted to 6.0) | 41.0 g/l. |

The donor element was soaked in the ferric ion solution contained in a shallow tray processor for 20 seconds at room temperature, and subsequently laminated to the dry silver step-image element between nip-rollers. After 60 seconds, the donor element was separated from the step-image element and the step-image element was discarded. The ferric ions had migrated to the step-image element, were reduced and had migrated back as evidenced by cyan dye image formation in the donor element. The Status A density of the coating ranged from 0.05 in the $D_{min}$ area to 0.71 in the $D_{max}$ area. The ferric ions had been reduced to ferrous ions by metallic silver in the step-image element, making those ferrous ions available for complexing to form the cyan dye in imaged areas.

EXAMPLE 2

Cyan Dye Formation in Silver Halide Element Containing Complexing Compound in Silver Halide Layer This example is like Example 1 except that the complexing compound is incorporated in the silver halide element rather than being supplied by a donor element.

A light-sensitive coating was prepared and coated on a transparent poly(ethylene terephthalate) support providing 0.83 g/m$^2$ of the complexing compound described in Example 1, 0.26 g Ag/m$^2$ of unsensitized silver chlorobromide polydisperse negative emulsion, 1.3 g/m$^2$ gelatin and 13.0 mg/m$^2$ of bis(vinylsulfonyl)-methyl ether hardener.

This photosensitive element was then exposed in a sensitometer through a graduated density step test object to give a full-scale image. The element was then processed to a black-and-white silver image using conventional D-72 type developer, stop-bath and fixer solutions followed by washing and drying. The resulting negative silver image had from less than 0.1 mg Ag/m$^2$ in the area up to 20 mg Ag/m$^2$ in the $D_{max}$ area.

A cover sheet of 26 g/m$^2$ unhardened gelatin on a similar support was soaked in the ferric ion solution described in Example 1 for 20 seconds at room temperature, and laminated to the processed silver-containing element between two nip-rollers. After 60 seconds, the cover sheet was separated from the element. The processed element, containing a cyan dye image was washed to remove residual ferric solution, fixed to remove residual silver halide, washed again and dried. The Status A density range from 0.09 in the $D_{min}$ area to 0.84 in the $D_{max}$ area.

EXAMPLE 3

Cyan Dye Formation in Silver Halide Element Containing Complexing Compound in Layer Adjacent Silver Halide Layer This example is similar to Example 2 except that the complexing compound was coated (0.83 g/m$^2$) in gelatin (1.3 g/m$^2$) in a separate layer above the silver halide emulsion layer. The resulting element was exposed and processed as in Example 2 to give a full-scale black-and-white silver image. The processed element was dipped for 60 seconds in the ferric ion solution described in Example 1, washed, fixed, washed again and dried. The Status A density ranged from 0.08 in the $D_{min}$ area to 1.4 in the $D_{max}$ area. The step-image of this element appeared visually sharp and well-defined.

EXAMPLE 4

Stability Comparison of Cyan Dyes

This is a comparison of the light and dark stability of a cyan dye image formed with the practice of this invention to the light and dark stability of a cyan dye provided by a conventional coupler.

An element was prepared and processed as described in Example 1. A step area nearest to density 1.0 in the processed element was incubated for three weeks and the decrease in density was calculated as a percent loss of the original density. The density loss data are presented in Table I below. The dark keeping incubation was carried out in two different temperature and relative humidity environments for three weeks. The light stability was measured by measuring the % dye loss after the element had been exposed to a high intensity 5500° K. light source (50 klx) for 21 days through a Wratten 2B filter.

A Control element was prepared by coating a similar photosensitive coating composition on a substrate, substituting the color-forming coupler 2-[α-(2,4-di-t-amylphenoxy)butyramido]-4,6-dichloro-5-methylphenol for the complexing compound. The element was developed with 4-amino-3-methyl-N-ethyl-N-β-(methanesulfonamido)ethylaniline. The processed element was incubated under the same conditions as above. The percent decrease in density at a step nearest an initial density of 1.0 was calculated. As the data in Table I illustrates, the cyan dye formed with the complexing compound according to the practice of this invention has significantly more dark keeping stability than the conventional cyan dye formed in the Control element.

TABLE I

| Element | % Density Loss (Dark Stability) 60° C./70% R.H. | % Density Loss (Dark Stability) 77° C./15% R.H. | % Dye Loss (Light Stability) 21 days |
|---|---|---|---|
| Control | 10 | 40 | 6.5 |
| Example 4 | 1 | 5 | 12 |

EXAMPLE 5

Magenta Dye Formation in Silver Halide Element

The complexing compound 4'-(3-hexadecanesulfonamidophenyl)-2,2':6',2''-terpyridine was prepared in the following manner.

4'-(3-Nitrophenyl)-2,2':6',2''-terpyridine was prepared from 3-(3-nitrophenyl)-1-(2-pyridyl)-2-propenone as described by Krohnke in *Synthesis,* 13ff (1976). The terpyridine compound (10 g) was suspended in 100 ml of tetrahydrofuran, 20 ml ethanol and 10 ml of triethylamine. After addition of 1.0 g 10% palladium on carbon, the mixture was hydrogenated at 40 psi ($2.75\times10^5$ pascals) for 6 hours. The solid aminophenylterpyridine reaction product was then obtained by filtration and evaporation of the solvent.

This product (11 g) was dissolved in 200 ml of pyridine, and 11 g of hexadecanesulfonyl chloride was added. The resulting mixture was stirred at room temperature for 20 hours and evaporated to dryness. The residue was dissolved in 400 ml of ethyl acetate and washed several times with water. The ethyl acetate was then evaporated and the residue was dissolved in a minimum volume of dichloromethane, and ligroin was added to slowly precipitate the product. Two additions of ligroin yielded a total of 15.9 g solid. Purification of the solid was done by column chromatography on silica gel using dichloromethane and dichloromethane:ethyl acetate 3:1 as eluting solvents.

A photosensitive element was prepared having a poly(ethylene terephthalate) support and a photosensitive layer containing: 0.6 g/m$^2$ of the complexing compound (dispersed in 1:1 N,N-diethylauramide and ethyl acetate), 0.26 g Ag/m² unsensitized silver chlorobromide polydisperse negative emulsion, 1.3 g/m² gelatin and 13 mg/m² bis(vinylsulfonyl)methyl ether hardener. Over the emulsion layer was coated a 1.1 g/m² gelatin overcoat.

The resulting element was exposed to a graduated density step test object and processed as described in Example 2 except that the developer was a conventional D-76 type. The resulting negative silver image had from 0.1 mg Ag/m² in the $D_{min}$ area to 22.0 mg Ag/m² in the area.

A cover sheet containing 26 g/m² unhardened gelatin on a transparent polyethylene terephthalate support was soaked for 60 seconds in the ferric ion solution and processed with the exposed element as described in Example 2. A magenta dye image was observed in the exposed element immediately. After 5 minutes of lamination, the cover sheet was removed from the exposed element. The Status A density of the magenta dye image ranged from less than 0.15 in the $D_{min}$ area to 1.4 in the $D_{max}$ area.

EXAMPLE 6

Stability Comparison of Magenta Dyes

This is a comparison of the light and dark stability of the magenta dye image obtained with the element described in Example 5 to the light and dark stability of a magenta dye obtained with a conventional color coupler.

A conventional photosensitive element was prepared similarly to the element of Example 5 using the magenta-forming color coupler 1-(2,4,6-trichlorophenyl)-3-(5-[α-(3-t-butyl-4-hydroxyphenoxy)tetradecanamido]-2-chloroanilino)-2-pyrazolin-5-one and developer 4-amino-3-methyl-N-ethyl-N-β-(methanesulfonamidoethyl)aniline. The exposed and developed elements were evaluated for light and dark keeping stability as described in Example 4. The results of the tests, given in Table II below, illustrate the improved light and dark stability of the magenta ferrous ion complex dye provided by the present invention over a conventional magenta dye.

TABLE II

| Element | % Dye Loss (Dark Stability) 60° C./70% R.H. | % Dye Loss (Dark Stability) 77° C./15% R.H. | % Dye Loss (Light Stability) 21 days |
|---|---|---|---|
| Control | 5.5 | 3 | 25 |
| Example 5 | not tested | 0 | 5 |

EXAMPLE 7

Magenta Dye Formation in Silver Halide Element

4'-(4-Octyloxy-3-sulfophenyl)2,2':6',2''-terpyridine, a magenta dye former was prepared in the following manner.

The chalcone, 2-(4-octyloxycinnamoyl)pyridine (10.9 g) and the pyridinium salt N-(2-pyridylcarbonylmethyl)pyridinium iodide (10.8 g) were combined with 150 ml of methanol, 60 ml of glacial acetic acid and 60 g of ammonium acetate. The resulting mixture was refluxed under argon for 20 hours. After cooling, the precipitate formed was filtered, washed with methanol and recrystallized two times from acetonitrile to yield 7 g of pure terpyridine, mp 101°–102°. To 25 ml of cold oleum in a round bottom flask, 4 g of the pure terpyridine was added in small portions over about 30 minutes. The reaction mixture was allowed to come to room temperature and stirred overnight. The reaction mixture was poured onto ice, filtered; the resulting solid washed with cold water, then ethanol, and dried in vacuo to provide 3.22 g of product.

A coating dispersion was prepared from 0.18 g of the sulfonated terpyridine described above and 1.8 g of gelatin by diluting to a total weight of 30 g with water (some $NH_4OH$ was added to give a clear solution). A coating composition was made from 8 g of the above dispersion plus 6.25 g water, 0.5 g of 7.5% saponin spreading aid and 0.25 g of 2% bis(vinylsulfonylmethyl) ether hardener. The resulting coating composition was coated on a poly(ethylene terephthalate) film support to provide a donor element.

A strip of the dry coating was soaked in the ferric ion solution described in Example 1 for about 20 seconds at room temperature and then laminated to a graduated density silver step-image element (<0.1 mg Ag/m² to about 19 mg Ag/m²) between nip-rollers. After 60 seconds, the donor element was separated from the step-image element and the step-image element was discarded. The remaining donor element containing a magenta dye image was washed and air-dried. The Status A density ranged from 0.09 in the $D_{min}$ area to 0.96 in the $D_{max}$ areas.

EXAMPLE 8

Magenta Dye Formation Using Polymeric Complexing Compound

Poly[acrylamide-co-4-(2-acrylamidoethoxy)-2,6-di(2-pyridyl)pyridine-co-N-(3-aminopropyl)methacrylamide hydrochloride](65:30:5 weight ratio) was prepared in the following manner.

To a solution of acrylamide (19.0 g, 0.55 moles), 4-(2-acrylamidoethoxy)-2,6-di(2-pyridyl)pyridine (18.0 g, 0.052 moles), N-(3-aminopropyl)methacrylamide hydrochloride (3.0 g, 0.017 moles) in t-butanol (420 ml) and methanol (120 ml) was added 2,2'-azobis(2-methylpropionitrile) (300 mg) as initiator. The resulting mixture was maintained under a nitrogen atmosphere and heated at 65°–70° C. in a constant temperature water bath. The polymer precipitated and after 3 hours was filtered. The polymer was dried under vacuum for 2 hours. The yield was 100%. The polymer had an inherent viscosity of 0.38 dl/g in a 0.1 molar solution of tetrabutylammonium bromide in dimethyl sulfoxide.

A coating dispersion of the polymer was prepared as follows: 1 g of the polymer was dissolved in about 45 ml of water. Small amounts of acetic acid were added to give a clear solution. Two ml of 7.5% saponin solution were added dropwise and then the total weight was brought to 60 g with water. Coating compositions were prepared from 15 g of the above dispersion plus 0.25 ml of 1% formaldehyde and coated on poly(ethylene terephthalate) film support to form donor elements.

A strip of the donor element was soaked in the ferric solution described in Example 1 for about 20 seconds at room temperature and then laminated to a graduated density silver step-image element (<0.1 mg Ag/m² to about 19 mg Ag/m²) between nip-rollers. After 60 seconds, the donor element was separated from the step-image element and the step-image element was discarded. The remaining donor element containing a magenta dye image was washed and air-dried. The Status A density ranged from 0.06 in the $D_{min}$ area to 1.42 in the $D_{max}$ area.

The invention has been described in detail with particular reference to preferred embodiments thereof, but it will be understood that variations and modifications can be effected within the spirit and scope of the invention.

We claim:

1. A process of forming a dye image in an element comprising a support having thereon at least one silver halide emulsion layer which has associated therewith an essentially colorless, immobile compound which is capable of complexing with ferrous ions, said complexing compund containing a complexing moiety represented by the structure:

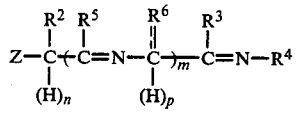

wherein m is zero or a positive integer 1 to 3, n and p are independently 0 or 1, ═ represents a single or double bond, Z is $R^1$—N═, O═, S═, $R^1$—P═, $(R^1)_2P$— or $(R^1)_3P$═, and when Z is $(R^1)_2P$—, n is 1, otherwise n is 0, $R^1$, $R^2$, $R^3$, $R^4$, $R^5$ and $R^6$ are independently hydrogen, amino, hydroxy, mercapto, alkoxy, alkyl, aryl or a heterocyclic moiety, and when $R^6$ is so defined, p is 1 and ═ is a single bond, if m is 0, $R^1$ and $R^2$, $R^2$ and $R^3$, and $R^3$ and $R^4$, taken together, can independently represent the carbon and heteroatoms necessary to complete a substituted or unsubstituted carbocyclic or heterocyclic nucleus, or, if m is 1 to 3, $R^1$ and $R^2$, $R^5$ and $R^6$, and $R^3$ and $R^4$ can independently represent the carbon and heteroatoms necessary to complete a substituted or unsubstituted heterocylic nucleus, and when $R^5$ and $R^6$ are so defined, p is 0 when ═ is a double bond, and p is 1 when ═ is a single bond, said process comprising the steps of imagewise exposing and developing said element to provide an imagewise distribution of metallic silver and thereby forming an imagewise distribution of a reducing agent for ferric ions, imagewise reducing a ferric compound with said reducing agent to provide an imagewise distribution of ferrous ions, and causing said ferrous ions to react with said complexing compound to form a ferrous ion complex dye.

2. The process of claim 1 wherein Z is $R^1$—N═ and m is 0 or 1.

3. The process of claim 1 comprising the steps of imagewise exposing and developing said silver halide emulsion layer to provide an imagewise distribution of metallic silver, physically contacting said metallic silver with a ferric compound, thereby reducing said ferric compound and providing an imagewise pattern of ferrous ions, and causing said ferrous ions to react with said complexing compound to form a ferrous ion-complex dye.

4. A process of forming dye images in an element comprising a support having thereon, in sequence, a red-sensitive emulsion unit which has associated therewith a first essentially colorless, immobile complexing compound which is capable of complexing with ferrous ions to form a cyan dye, a green-sensitive silver halide emulsion unit which has associated therewith a second essentially colorless, immobile complexing compound which is capable of complexing with ferrous ions to form a magenta dye, and a blue-sensitive silver halide emulsion unit which has associated therewith a first essentially colorless, immobile complexing compound which is capable of complexing with ferrous ions to form a yellow dye, said complexing compound containing a complexing moiety represented by the structure:

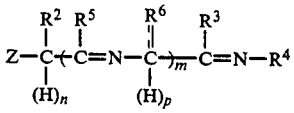

wherein m is zero or a positive integer 1 to 3, n and p are independently 0 or 1, ═ represents a single or double bond, Z is $R^1$—N═, O═, S═, $R^1$—P═, $(R^1)_2P$— or $(R^1)_3P$═, and when Z is $(R^1)_2P$— n is 1, otherwise n is 0, $R^1$, $R^2$, $R^3$, $R^4$, $R^5$ and $R^6$ are independently hydrogen, amino, hydroxy, mercapto, alkoxy, alkyl, aryl or a heterocyclic moiety, and when $R^6$ is so defined, p is 1 and ═ is a single bond, if m is 0, $R^1$ and $R^2$, $R^2$ and $R^3$, and $R^3$ and $R^4$, taken together, can independently represent the carbon and heteroatoms necessary to complete a substituted or unsubstituted carbocyclic or heterocyclic nucleus, or, if m is 1 to 3, $R^1$ and $R^2$, $R^5$ and $R^6$, and $R^3$ and $R^4$ can independently represent the carbon and heteroatoms necessary to complete a substituted or unsubstituted heterocyclic nucleus, and when $R^5$ and $R^6$ are so defined, p is 0 when ═ is a double bond, and p is 1 when ═ is a single bond, said process comprising the steps of imagewise exposing said element to actinic radiation and developing said element to provide an imagewise distribution of metallic silver in each of said emulsion units, physically contacting said metallic silver in said emulsion units with a ferric compound, thereby reducing said ferric compound and providing an imagewise pattern of ferrous ions in each of said emulsion units, and causing said ferrous ions to react with said complexing compounds to form ferrous ion complex dyes.

5. The process of claim 4 wherein said second complexing compound is a polymer composed of recurring units having the structure:

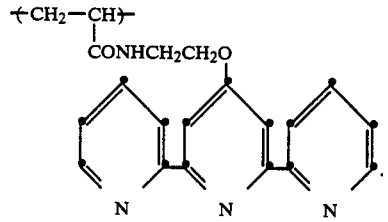

6. The process of claim 4 wherein said element is a photographic paper product.

7. The process of claim 4 wherein a reversal image is obtained.

8. An element comprising a support having thereon at least one silver halide emulsion layer which has associated therewith an essentially colorless, immobile compound which is capable of complexing with ferrous ions to form a ferrous ion complex dye, said complexing compound of said element containing a complexing moiety represented by the structure:

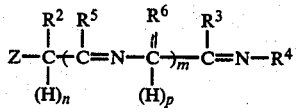

wherein m is zero or a positive integer 1 to 3, n and p are independently 0 or 1, ═ represents a single or double bond, Z is $R^1$—N═, O═, S═, $R^1$—P═, $(R^1)_2P$— or $(R^1)_3P$═, and when Z is $(R^1)_2P$—, n is 1, otherwise n is 0, $R^1$, $R^2$, $R^3$, $R^4$, $R^5$ and $R^6$ are independently hydrogen, amino, hydroxy, mercapto, alkoxy, alkyl, aryl or a heterocyclic moiety, and when $R^6$ is so defined, p is 1 and ═ is a single bond, if m is 0, $R^1$ and $R^2$, $R^2$ and $R^3$, and $R^3$ and $R^4$, taken together, can independently represent the carbon and heteroatoms necessary to complete a substituted or unsubstituted carbocyclic or heterocyclic nucleus, or, if m is 1 to 3, $R^1$ and $R^2$, $R^5$ and $R^6$, and $R^3$ and $R^4$ can independently represent the carbon and heteroatoms necessary to complete a substituted or unsubstituted heterocyclic nucleus, and when $R^5$ and $R^6$ are so defined, p is 0 when ═ is a double bond, and p is 1 when ═ is a single bond.

9. The element of claim 8 wherein Z is $R^1$—N═ and m is 0 or 1.

10. A photographic element comprising a support having thereon, in order, a red-sensitive emulsion unit which has associated therewith a first essentially colorless, immobile complexing compound which is capable of complexing with ferrous ions to form a cyan dye, a green-sensitive silver halide emulsion unit which has associated therewith a second essentially colorless, immobile complexing compound which is capable of complexing with ferrous ions to form a magenta dye, and a blue-sensitive silver halide emulsion unit which has associated therewith a first essentially colorless, immobile complexing compound which is capable of complexing with ferrous ions to form a yellow dye, each of said complexing compounds containing a complexing moiety represented by the structure:

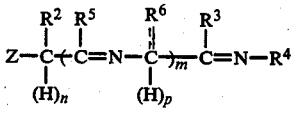

wherein m is zero or a positive integer 1 to 3, n and p are independently 0 or 1, ═ represents a single or double bond, Z is $R^1$—N═, O═, S═, $R^1$—P═, $(R^1)_2P$— or $(R^1)_3P$═, and Z is $(R^1)_2P$—, n is 1, otherwise n is 0, $R^1$, $R^2$, $R^3$, $R^4$, $R^5$ and $R^6$ are independently hydrogen, amino, hydroxy, mercapto, alkoxy, alkyl, aryl or a heterocyclic moiety, and when $R^6$ is so defined, p is 1 and ═ is a single bond, if m is 0, $R^1$ and $R^2$, $R^2$ and $R^3$, and $R^3$ and $R^4$, taken together, can independently represent the carbon and heteroatoms necessary to complete a substituted or unsubstituted carbocyclic or heterocyclic nucleus, or, if m is 1 to 3, $R^1$ and $R^2$, $R^5$ and $R^6$, and $R^3$ and $R^4$ can independently represent the carbon and heteroatoms necessary to complete a substituted or unsubstituted heterocyclic nucleus, and when $R^5$ and $R^6$ are so defined, p is 0 when ═ is a double bond, and p is 1 when ═ is a single bond.

11. The element of claim 10 wherein Z is $R^1$—N═ and m is 0 or 1.

12. The element of claim 10 wherein said second complexing compound is a polymer composed of recurring units having the structure:

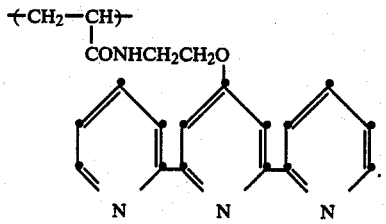

* * * * *

UNITED STATES PATENT OFFICE

CERTIFICATE OF CORRECTION

PATENT NO. : 4,568,633

DATED : February 4, 1986

INVENTOR(S) : Frank V. Lovecchio; James A. Reczek and Robert C. Stewart

It is certified that error appears in the above-identified patent and that said Letters Patent are hereby corrected as shown below:

Column 3, lines 1 and 2, where the blank spaces appear " insert -- --- --.

Signed and Sealed this

Eighteenth Day of November, 1986

*Attest:*

DONALD J. QUIGG

*Attesting Officer* *Commissioner of Patents and Trademarks*